US006270310B1

(12) United States Patent
Gaston et al.

(10) Patent No.: US 6,270,310 B1
(45) Date of Patent: Aug. 7, 2001

(54) FUEL PUMP ASSEMBLY

(75) Inventors: Robert Duane Gaston, Greencastle, IN (US); Mark Edward Hipp, South Lyon; Dequan Yu, Ann Arbor, both of MI (US)

(73) Assignee: Ford Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/408,056

(22) Filed: Sep. 29, 1999

(51) Int. Cl.[7] ..... F04D 1/04
(52) U.S. Cl. ..... 415/55.1; 415/228; 416/189
(58) Field of Search ..... 415/55.1, 228, 415/214.1, 227; 416/189, 231 R

(56) References Cited

U.S. PATENT DOCUMENTS 4,403,910 * 9/1983 Watanabe et al. ..... 415/55.1
4,408,952 * 10/1983 Schweinfurter ..... 415/55.1
4,915,582 * 4/1990 Nishikawa ..... 415/55.1
4,943,209 7/1990 Beehler .
5,009,570 4/1991 Richardson .
5,338,165 * 8/1994 Brockner et al. ..... 417/423.1
5,375,970 * 12/1994 Iwai et al. ..... 415/55.1
5,409,357 * 4/1995 Yu et al. ..... 417/423.1
5,415,521 * 5/1995 Hufnagel et al. ..... 415/55.1
5,549,446 8/1996 Gaston et al. .
5,601,398 * 2/1997 Treiber et al. ..... 415/55.1
5,711,276 * 1/1998 Frank ..... 123/495
5,775,878 7/1998 Maumus et al. .
5,823,753 10/1998 Kemmerling .
5,899,673 * 5/1999 Bosley et al. ..... 417/423.14

* cited by examiner

*Primary Examiner*—F. Daniel Lopez
*Assistant Examiner*—Ninh Nguyen
(74) *Attorney, Agent, or Firm*—Ford Global Tech, Inc.

(57) ABSTRACT

A fuel pump assembly 10 including a motor 12, a drive shaft 14 which is rotatably coupled to motor 12, an impeller 16, and a chamber assembly 18. Fuel pump assembly 10 has improved efficiency due to the substantial reduction and/or elimination of frictional contact between impeller 16 and the respective interior surfaces 70, 72 of chamber 18.

17 Claims, 8 Drawing Sheets

FUEL PUMP ASSEMBLY

FIELD OF THE INVENTION

This invention relates to a fuel pump assembly and more particularly to a vehicle fuel pump assembly having an improved operating efficiency.

BACKGROUND OF THE INVENTION

Fuel pump assemblies are typically used to selectively pump and/or transfer fuel from a fuel-containing tank or storage receptacle to an engine, thereby allowing the fuel to be combusted within the engine and causing the engine to perform some desired function or operation.

A fuel pump assembly is typically located within a vehicle fuel tank and normally includes an electric motor, an impeller, and a shaft which connects the electric motor to the impeller. The impeller is usually and movably housed and/or contained within a pump chamber or cavity which is formed by the cooperative engagement of a chamber cover member and a chamber body member, and which is communicatively coupled to the vehicle engine.

In operation, the electric motor selectively rotates and/or "drives" the shaft, thereby rotating the impeller. The rotating impeller "draws" and/or pumps fuel, such as gasoline or ethanol, from the fuel tank, through the fuel pump chamber, and into the vehicle engine. It is desirable to provide relatively large amounts of the fuel at a relatively high rate and/or speed in order to allow the vehicle to be selectively driven at relatively high and desirable speeds. It is further desirable to allow the fuel pump assembly to operate efficiently (e.g., without substantial losses of energy).

The rate and the speed at which the fuel is pumped into the vehicle engine can be and has been desirably increased by increasing the diameter of the impeller and increasing the size of the impeller containing pump chamber. While these modified fuel pumps have reliably pumped increased amounts of fuel at increased rates or speeds, they suffer from some undesirable drawbacks.

For example and without limitation, the pressure differential, which is created within the pump chamber by the rotating impeller, causes the impeller to undesirably contact the interior chamber forming surfaces, thereby creating significant frictional energy losses. These frictional losses decrease the overall speed of the impeller and decrease the overall efficiency of the fuel pump. Importantly, the amount of these frictional energy losses increase as the size or the diameter of the impeller is increased due the concomitant increase in the amount of the impeller surface area which operatively and frictionally contacts the interior surfaces of the chamber. Hence, increasing the size and/or the diameter of the impeller actually increases the amount of such undesirable frictional energy losses. Furthermore, the relatively large impeller tends to operatively "warp" or deform, thereby further increasing the amount of frictional contact between the impeller and the interior surfaces of the chamber and further undesirably increasing such frictional energy losses.

These prior vehicle fuel pump assemblies suffer additional energy losses due to the fluid displacement occurring at the tips or the ends of the impeller blades. In order to minimize these known "blade tip losses", the chamber body and/or cover is usually created or "machined" within very strict or "tight" tolerance limits in order to minimize the distance between the blade tips and the interior surfaces of the pump chamber. This requirement undesirably increases the manufacturing and/or production cost of these prior fuel pump assemblies and the relatively short distance between the impeller blades and the interior surfaces of the pump chamber undesirably increases the likelihood of frictional contact between the blades and the interior chamber surfaces.

There is therefore a need for an improved fuel pump assembly for use in a vehicle, which substantially reduces and/or eliminates such previously described frictional contact and "blade tip" type energy losses, and which reliably provides relatively large amounts of fuel to the vehicle engine at relatively high rates of speed.

SUMMARY OF THE INVENTION

It is a first object of the invention to provide a vehicle fuel pump assembly which overcomes some or all of the previously delineated drawbacks of prior vehicle fuel pumps.

It is a second object of the invention to provide a vehicle fuel pump assembly which includes a chamber cavity having a selectively rotating impeller, the fuel pump being adapted to substantially reduce and/or eliminate contact between the rotating impeller and the chamber forming surfaces.

It is a third object of the present invention to provide a vehicle fuel pump assembly which substantially reduces and/or minimizes blade tip energy losses.

According to a first aspect of the present invention, a fuel pump assembly for use with a vehicle of the type having a fuel tank which contains a quantity of fuel and a combustion engine is provided. The fuel pump assembly includes a motor having a selectively rotating shaft; a chamber which receives the shaft and which is communicatively coupled to the fuel tank and to the combustion engine; and an impeller which is coupled to the shaft, which is movably disposed within the chamber, and which has a first body portion and several blade portions which project from the first body portion and which are each respectively thinner than the first body portion.

According to a second aspect of the present invention, a method is provided for increasing the efficiency of a fuel pump of the type having a selectively rotating impeller including several projecting blades of a certain respective of thickness. The method includes the steps of reducing the certain thickness of each of the several blades; and interconnecting the several blades, thereby increasing the efficiency of the fuel pump.

These and other objects, aspects, features, and advantages of the present invention will become apparent from a consideration of the following specification and the attached drawings.

DETAILED DESCRIPTION OF THE PREFERRED EMBODIMENT

Figure 1:
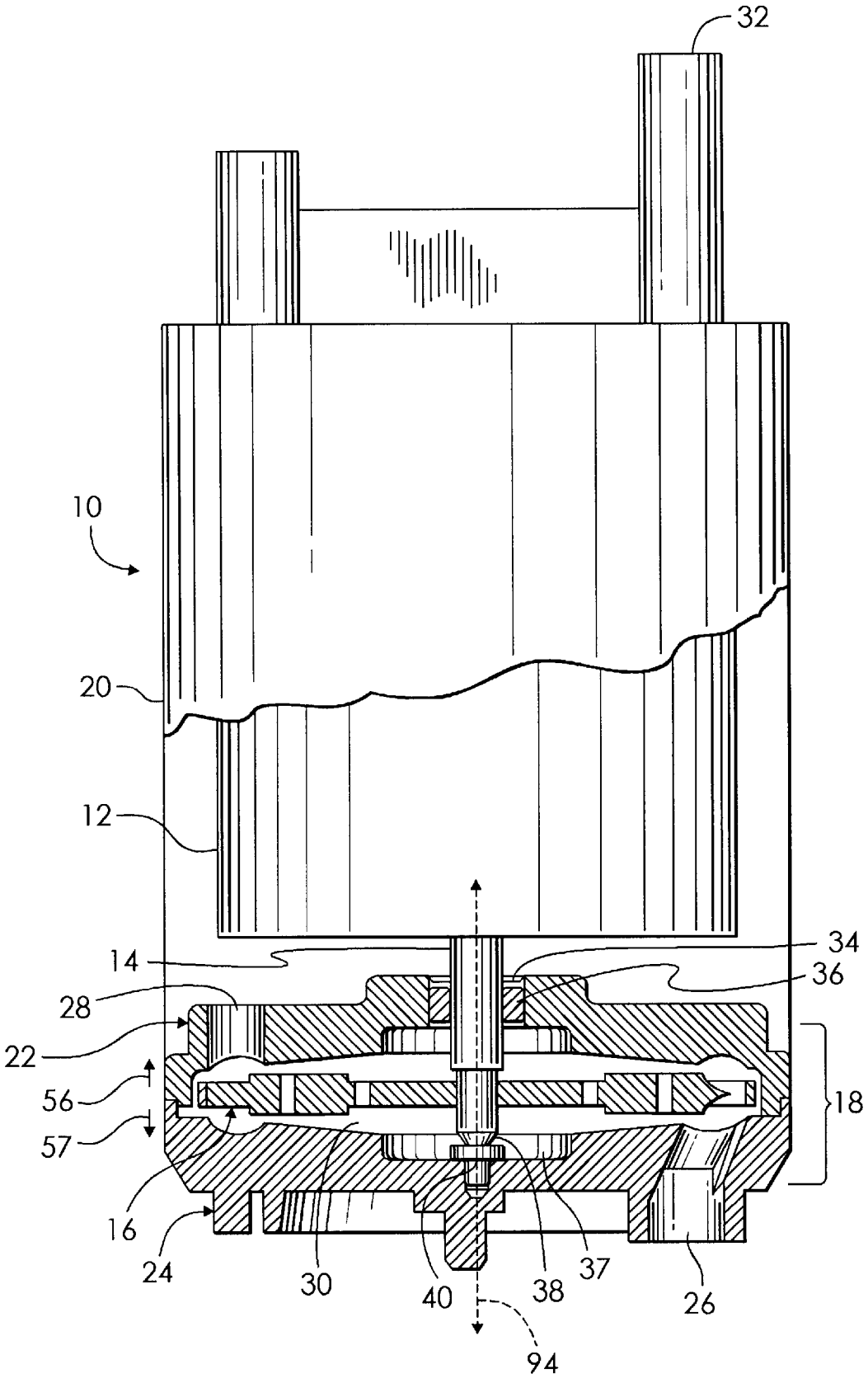
FIG. 1 is a front and partial cut-away view of a fuel pump assembly which is made in accordance with the teachings of the preferred embodiment of the invention.

Referring now to FIGS. 1–6, there is shown a vehicle fuel pump assembly 10 which is made in accordance with the teachings of the preferred embodiment of the invention. As shown, fuel pump assembly 10 includes a motor 12, a drive shaft 14 which is rotatably and operatively coupled to the motor 12, and a chamber assembly 18 which rotatably receives the driveshaft 14. Motor 12, driveshaft 14, and chamber assembly 18 are collectively contained within a generally cylindrical housing 20.

Chamber assembly 18 includes a chamber cover member 24 having an integrally formed fuel intake passage or port 26, a chamber body member 22 having a fuel outlet aperture or port 28 and operatively cooperating with cover member 22 to form a chamber cavity 30, and an impeller 16 which is coupled to shaft 14 and which is rotatably disposed within cavity 30. Assembly 10 further includes a pump outlet member or port 32 which is communicatively coupled to aperture or port 28.

As described more fully and completely below, the selective rotation of impeller 16 causes fuel to be selectively received by the assembly 18 through port 26. The received fuel is then pumped and/or propelled through cavity 30 and through aperture 28, before exiting assembly 10 from port 32. As should be realized by those of ordinary skill in the art, port or aperture 32 is selectively and communicatively coupled to a conventional vehicle combustion engine (not shown), thereby allowing the fuel to be received and selectively combusted within the engine.

In the preferred embodiment of the invention, motor 12 comprises a conventional and commercially available electric "DC"-type motor (e.g., a motor which is powered through direct current electricity), and is adapted to selectively and rotatably drive shaft 14. Particularly, shaft 14 extends from motor 12 into chamber assembly 18 through an aperture 34 which is formed within body member 22. As shown, aperture 34 contains a conventional and commercially available "set" or pair of bearings 36 which rotatably engage shaft 14 and allow shaft 14 to rotate freely within aperture 34. These bearings 36 cause shaft 14 to rotate about an axis of rotation 94 which, in one non-limiting embodiment of the invention, is made to maintain a position which substantially overlays and/or corresponds to the longitudinal axis of symmetry of aperture 34. Shaft 14 further extends through cavity 30 and into the slot 37 which is formed within cover member 24. The rounded end 38 of shaft 14 rotatably rests upon a conventional "thrust button" or member 40 which is secured within slot 37.

Figure 2:
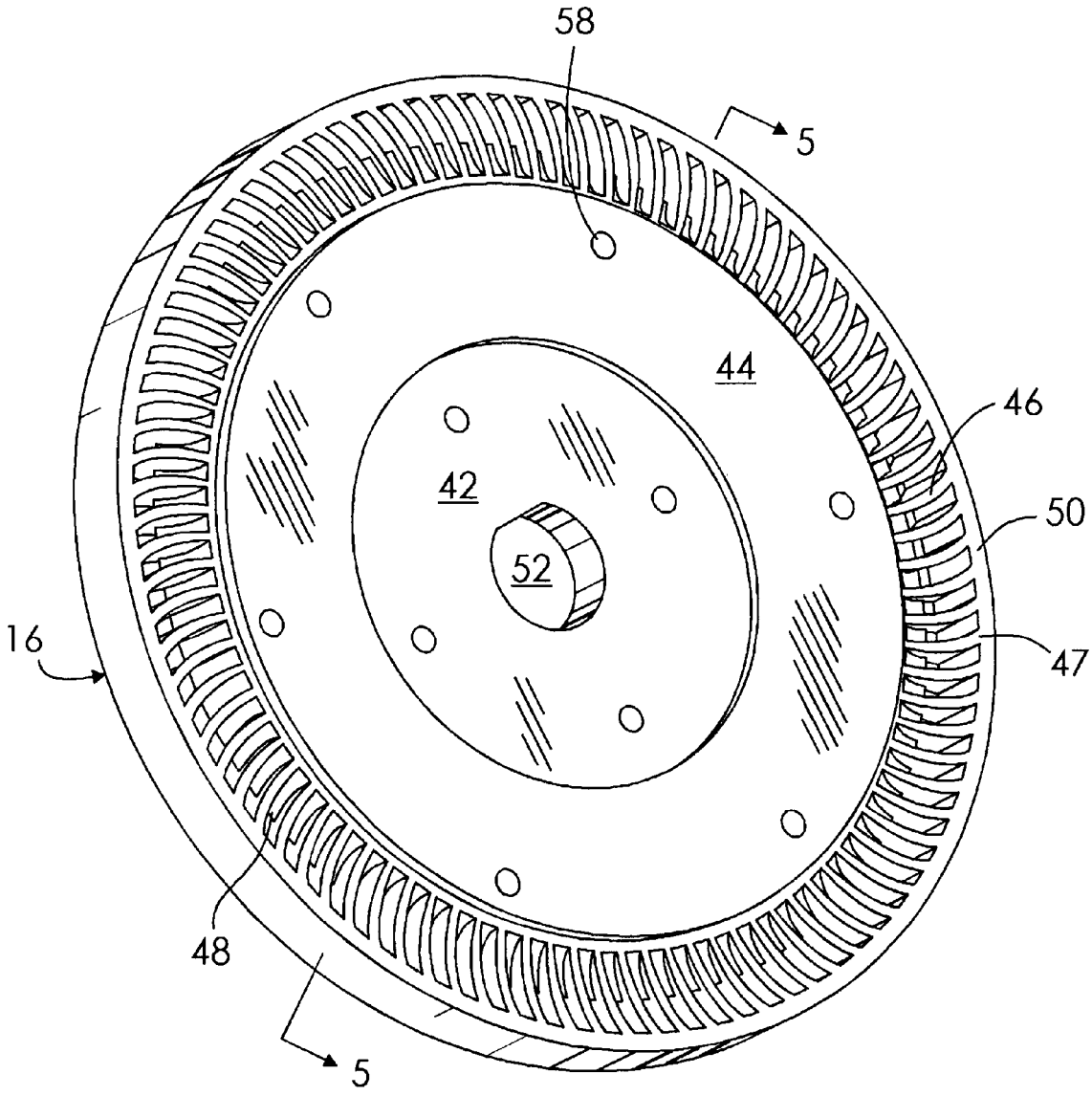
FIG. 2 is an unassembled perspective view of the impeller which is employed within the fuel pump assembly shown in FIG. 1.
Figure 5:
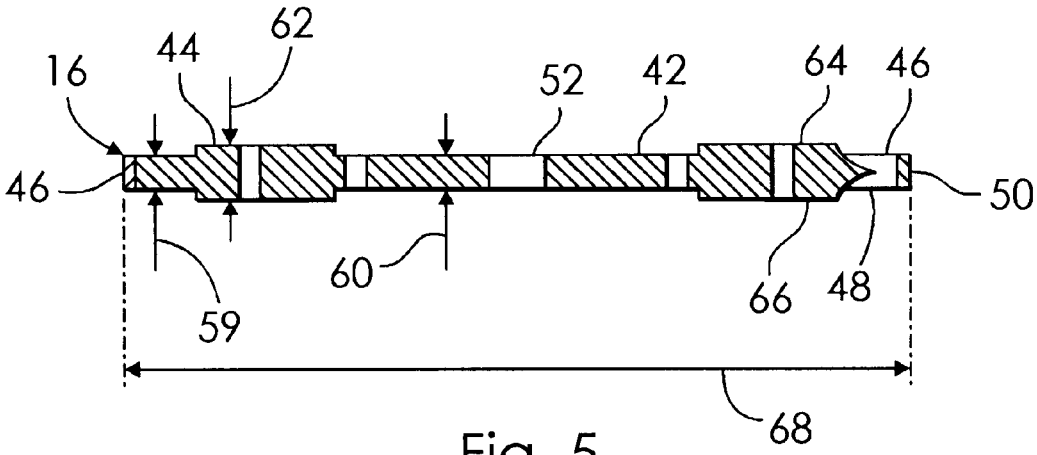
FIG. 5 is a cross sectional view of the impeller shown in FIGS. 1 and 2.

As best shown in FIGS. 2 and 5, impeller 16 is generally circular in shape and includes a generally circular and relatively thin inner body or core portion 42; a generally circular and relatively thick or "landed" outer body or core portion 44; several relatively thin and curved vanes or blades 46 which are circumferentially disposed upon and which project and/or protrude from portion 44; several flange portions or "vane groove" 48 which project from portion 44 and which are each operatively and abuttingly positioned between a unique pair of blades 46; and an outer ring portion 50 which is connected to blade tips 47, thereby interconnecting blades 46. Portions 42, 44, blades 46, flange portion or "vane groove" 48 and ring 50 are, in one non-limiting embodiment of the invention, integrally formed from a durable corrosion-resistant material, such as a phenolic or "PPS" type plastic. In the preferred embodiment, impeller 16 is molded by use of a conventional thermal molding process and may include conventional filler materials such as glass, resin and/or graphite.

Core portion 42 includes a centrally disposed aperture 52 which matingly and frictionally receives shaft 14. Hence, the shaft 14 is operatively coupled to the impeller 16, thereby causing the impeller 16 to rotate and to "freely" slide or travel upon shaft 14 and within chamber cavity 30 in the directions illustrated by arrows 56, 57 (e.g., along axis 94), shown in FIG. 1. Core portions 42 and 44 further each include several substantially identical and distributably disposed pressure relief apertures 58. Particularly, apertures 58 allow fuel to pass between opposed side surfaces of impeller 16, thereby substantially equalizing the pressure within cavity 30, substantially reducing the amount of force imparted upon impeller 16 in the directions illustrated by arrows 56, 57 and reducing the amount of frictional contact between impeller 16 and the body 22 and/or cover 24.

To further substantially prevent and/or reduce frictional contact between the impeller 16 and body member 22 and between the impeller 16 and the cover member 24, the "thickness" or the width 59 of the blades 46 and the ring portion 50 and the "thickness" or the width 60 of portion 42 are each made to be respectively uniform and relatively less than the relatively uniform width or "thickness" 62 of portion 44. As discussed more fully and completely below, the narrowing and/or thinning of blades 46, ring 50, and portion 42 ensures that blades 46, ring 50, and portion 42 will not contact the cover member 24 and/or the body member 22 during operation, thereby minimizing the contact between impeller 16 and the respective interior surfaces 70, 72 which form and/or create the pump chamber 30 and allowing the fuel pump assembly 10 to become more efficient.

In one non-limiting embodiment of the present invention, the thickness 59 is approximately 4.65 millimeters, the thickness 60 is approximately 4.65 millimeters, the thickness 62 is approximately 4.75 millimeters, and the overall diameter 68 of impeller 16 is approximately 54 millimeters.

Figure 3:
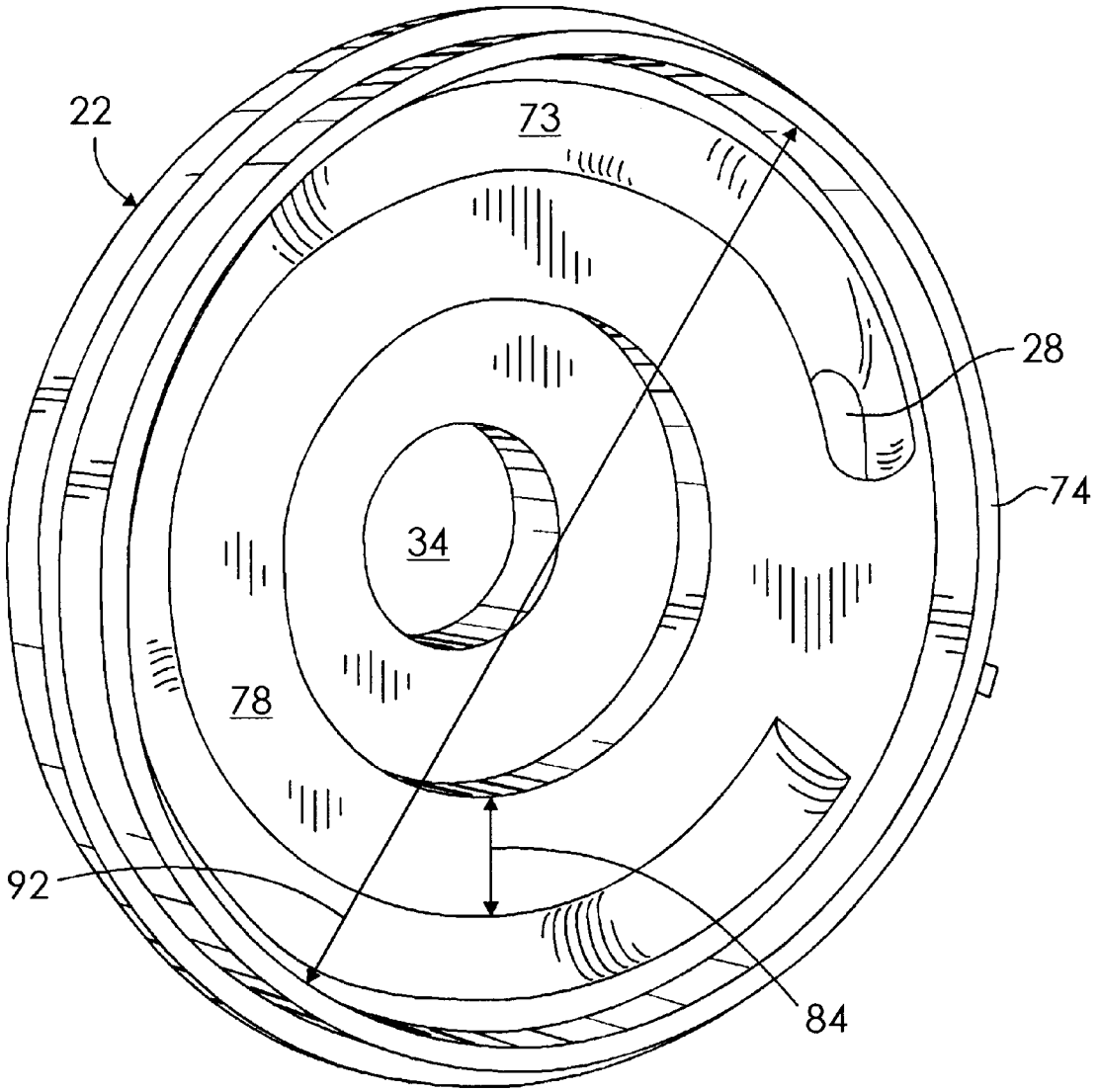
FIG. 3 is an unassembled perspective view of the pump chamber body member which is employed within the fuel pump assembly shown in FIG. 1.
Figure 4:
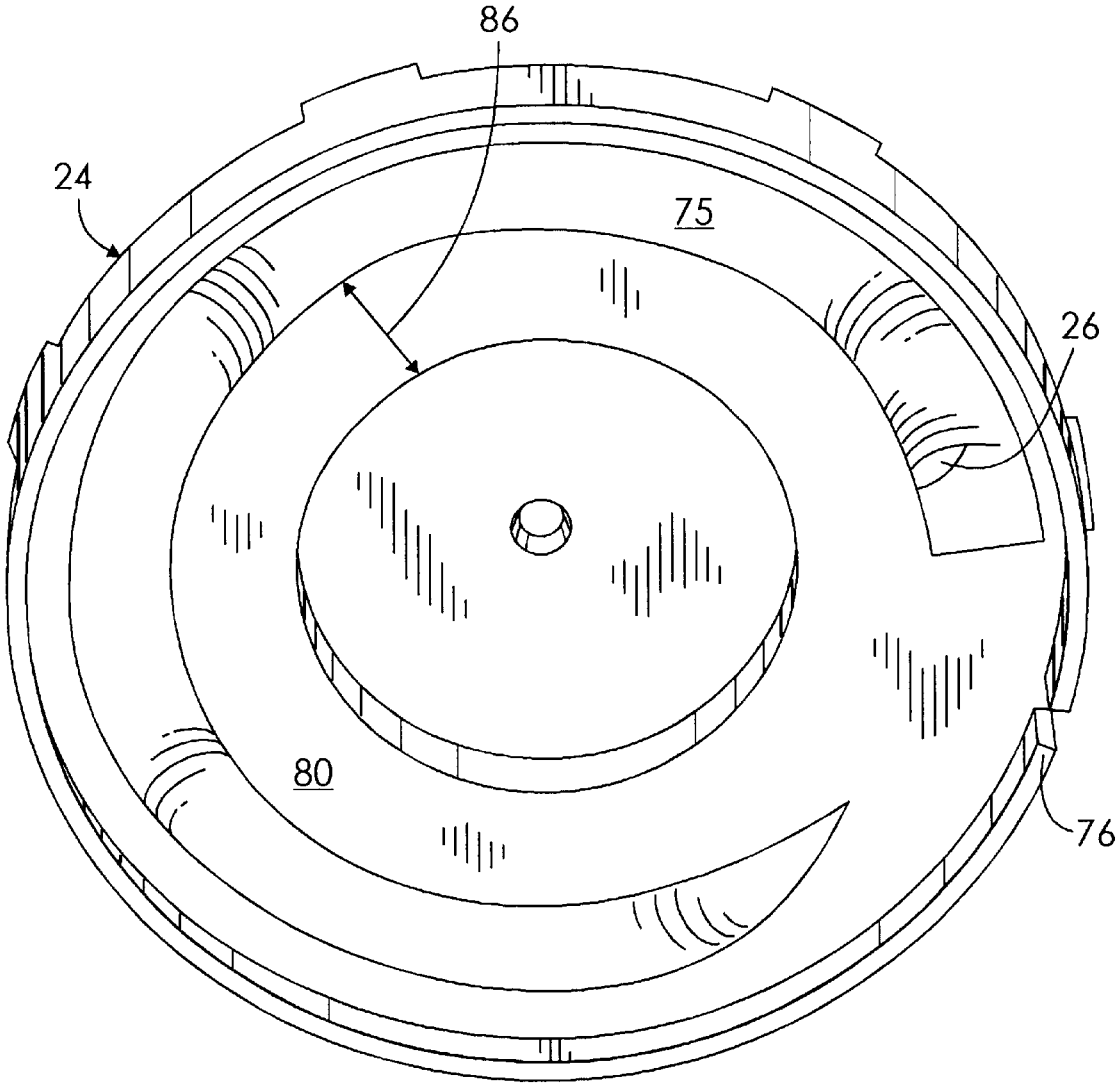
FIG. 4 is an unassembled perspective view of the pump chamber cover which is employed within the fuel pump assembly shown in FIG. 1.
Figure 6:
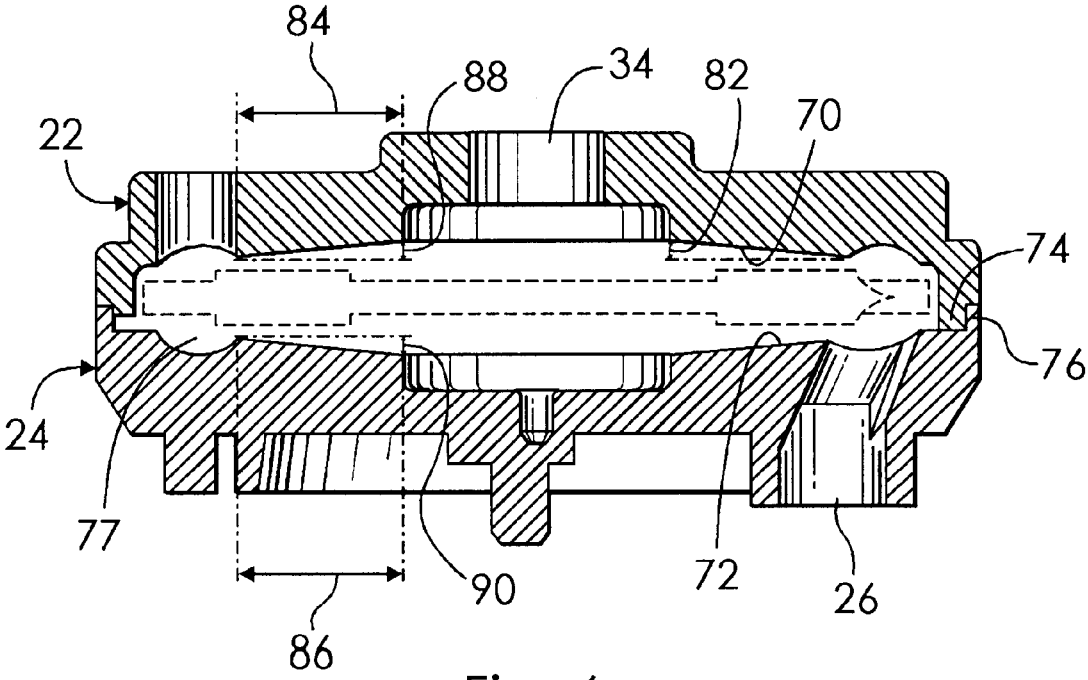
FIG. 6 is a cross sectional view of a pump chamber formed by the selectively and operative engagement of the pump chamber body shown in FIG. 3 and the pump chamber cover shown in FIG. 4.

Body member 22 and cover member 24 are best illustrated in FIGS. 3, 4 and 6. As shown, body member 22 and cover member 24 are preferably manufactured from a relatively durable and substantially corrosive-resistant material, such as a plastic material, anodized aluminum, or any other suitable material or composite. Further, body member 22 and cover member 24 each respectively includes an outer ridge or lip portion 74, 76 which selectively and cooperatively engage or interlock, as illustrated in FIGS. 1 and 6, thereby selectively creating a substantially sealed cavity 30. Body member 22 and cover member 24 each further respectively include an integrally formed semi-circular groove 73, 75. When body member 22 and cover member 24 are operatively interconnected, grooves 73, 75 cooperatively form a fuel passage channel 77 which directs the flow of the received fuel within the cavity 30 and, more particularly, provides a path of fuel travel from the inlet 26 to the outlet 28.

Further, body member 22 and cover member 24 respectively include tapered surface portions 78, 80. In one non-limiting embodiment, portions 78, 80 are each "tapered" or sloped at a substantially identical rate or angle 82, which in one non-limiting embodiment is approximately equal to 0.36 degrees. Further, in one non-limiting embodiment, portions 78, 80 each have a respective and substantially identical uniform width 84, 86 of approximately 8 millimeters. Portions 78, 80 cooperatively widen the portion of the chamber 30 in which the relatively thick portion 44 of impeller 16 operatively resides, thereby allowing impeller 16 to move in the direction of arrows 56, 57 without immediately engaging the interior chamber forming surfaces 70, 72, thereby further increasing the overall efficiency of the fuel pump assembly 10. In one non-limiting embodiment, distances 88, 90 which respectively correspond to the maximum distance by which each portion 78, 80 "widens" chamber 30 is approximately 0.05 millimeters.

The overall diameter 92 of cavity 30 formed by the selective engagement of body member 22 and cover member 24 is greater than the overall impeller diameter 68 to ensure sufficient clearance between blade tips and the chamber forming surface. In one non-limiting embodiment, the overall diameter 92 of cavity 30 is approximately 54.2 millimeters. As discussed below, ring portion 50 allows diameter 92 to be relatively and considerably greater than impeller diameter 68. Particularly, ring portion 50 substantially eliminates/reduces blade tip losses, thereby allowing for a "looser" tolerance between diameter 92 and diameter 68, thereby obviating the need to precisely machine body 22 and/or cover 24. Furthermore, the "tapering" or "sloping" of body member 22 and cover member 24 further reduces the amount of frictional contact between impeller 16 and the interior pump chamber forming surfaces 70, 72.

In operation, the selective rotation of shaft 14 by motor 12 causes impeller 16 to rotate within cavity 30 about the axis of rotation 94 of shaft 14. The rotation of impeller 16 selectively draws fuel through inlet 26 and pumps and/or propels the received fuel through cavity 30 and aperture 28, and out of assembly 10 through port 32. The rotation of impeller 16 causes and/or creates forces which act in the directions of arrows 56, 57. Particularly, these forces cause impeller 16 to slide upward and/or downward upon shaft 14. Unlike prior pump assemblies, these forces do not cause substantial frictional contact between the operatively rotating impeller 16 and the pump chamber forming surfaces 70, 72.

If impeller 16 is forced "upward" (i.e., in the direction of arrow 56) only the top surface 64 of portion 44 will contact the interior surface 70 of body member 22, thereby allowing the relatively thin blades 46 and the ring portion 50 to rotate freely below surface 70. Should the impeller 16 be forced "downward" (i.e., in the direction of arrow 57), only the bottom surface 66 of portion 44 will contact the pump chamber forming interior surface 72 of cover member 24, thereby allowing the relatively thin blades 46 and the ring portion 50 to rotate freely above surface 72.

The "tapering" or "sloping" of portions 78, 80 (e.g., the selective "widening" of cavity 30) combined with the relatively thin inner core portion 42 further minimize the contact between impeller 16 and the respective interior surfaces 70, 72, in a substantially similar manner. That is, this "tapering" substantially permits contact to occur between only the portion 44 and the portion of surfaces 70, 72 nearest to and/or proximate to respective channels 73, 75, while substantially preventing contact between portion 42 and surfaces 70, 72. In this manner, frictional contact between the impeller 16 and body 22 and/or cover member 24 is minimized, thereby providing relatively greater impeller speeds, an increased pumping rate, and improved overall pump efficiency.

The efficiency of pump assembly 10 is further increased due to ring 50. Particularly, ring portion 50 allows diameter 92 to be significantly greater than impeller diameter 68, thereby allowing for a "looser" tolerance. This "looser" tolerance provides a greater distance between the outer circumference of impeller 68 and the circumference of cavity 30, thereby decreasing the amount and likelihood of contact occurring between blades 46 and body 22 and/or cover 24. This "looser" tolerance is achieved without "blade" tip losses, as ring 50 encompasses and/or interconnects the tips 47 of blades 46, thereby preventing or substantially reducing undesirable blade tip fluid displacement during the rotation of impeller 16.

It should be understood that the thin portion 42 of impeller 16, the tapered body member 22 and cover member 24, the thin blades 46, and/or the ring portion 50 may each be used independently to unilaterally reduce the amount of frictional contact within a fuel pump assembly as previously described. These aspects/features may also be desirably combined with a single fuel pump assembly.

Figure 7:
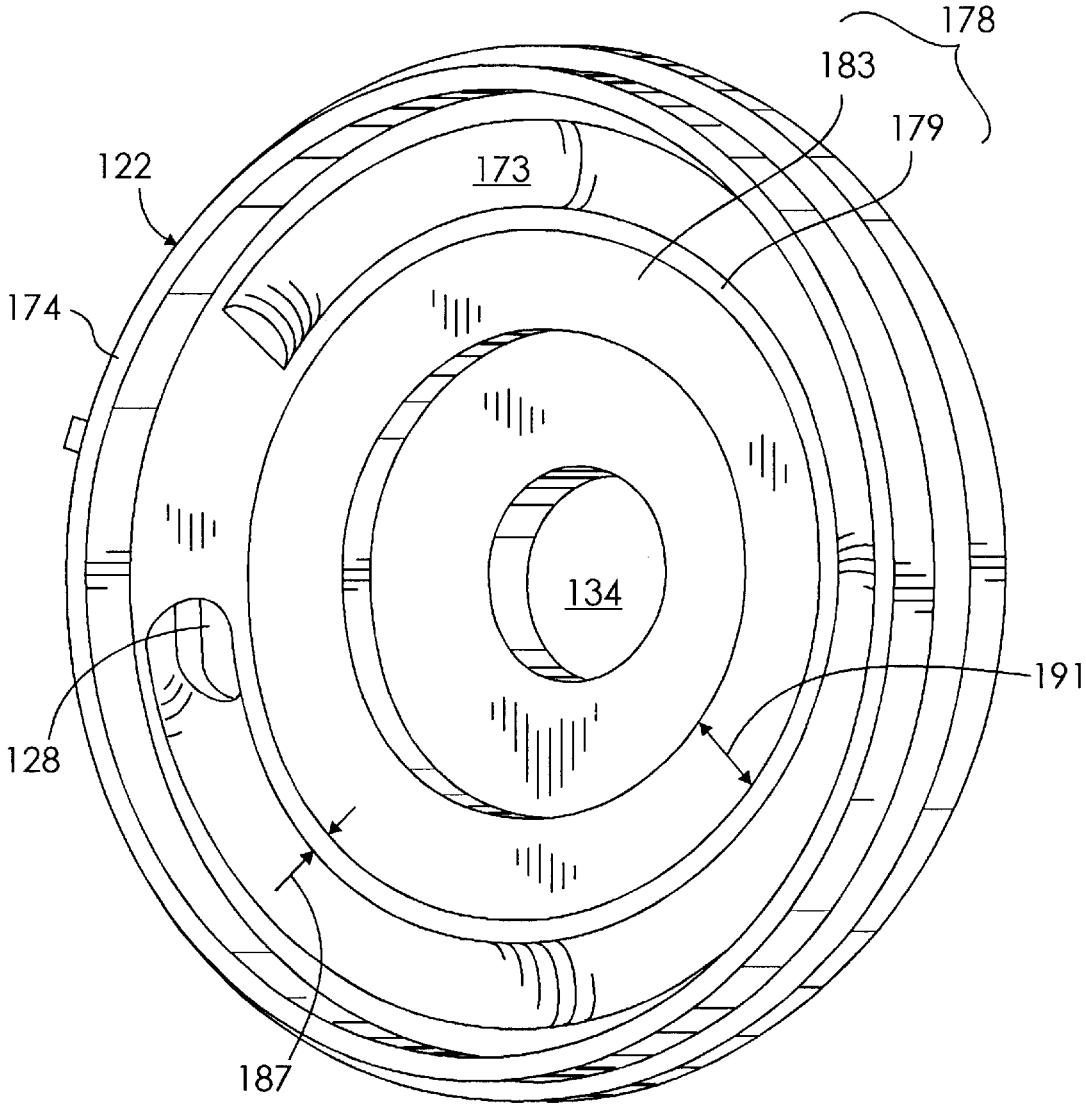
FIG. 7 is a perspective unassembled view of a pump chamber body member which is made in accordance with the teachings of a second embodiment of the invention and which is adapted for use with fuel pump which is shown in FIG. 1.
Figure 8:
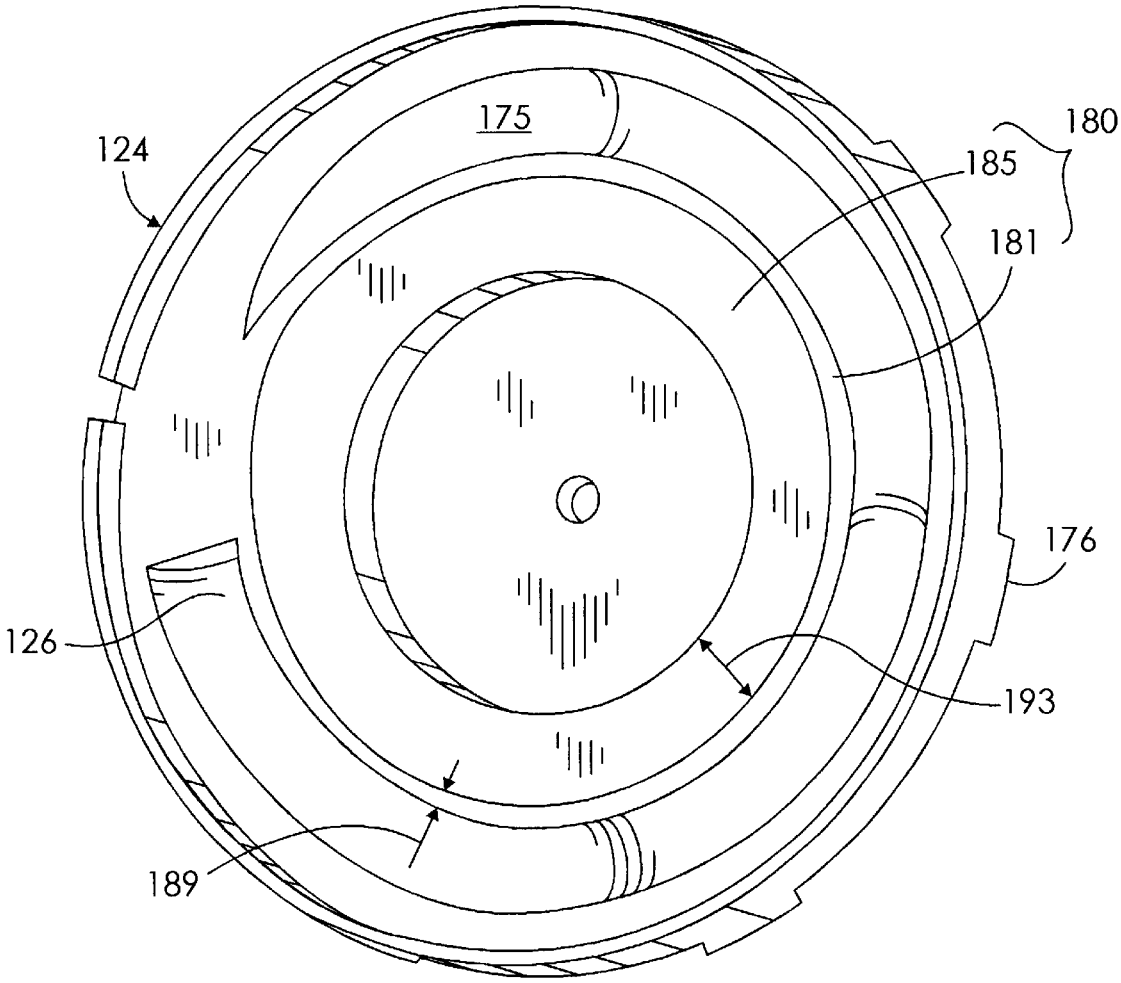
FIG. 8 is a perspective unassembled view of a pump chamber cover member which is made in accordance with the teachings of a second embodiment of the invention and which is adapted for use with the fuel pump shown in FIG. 1.
Figure 9:
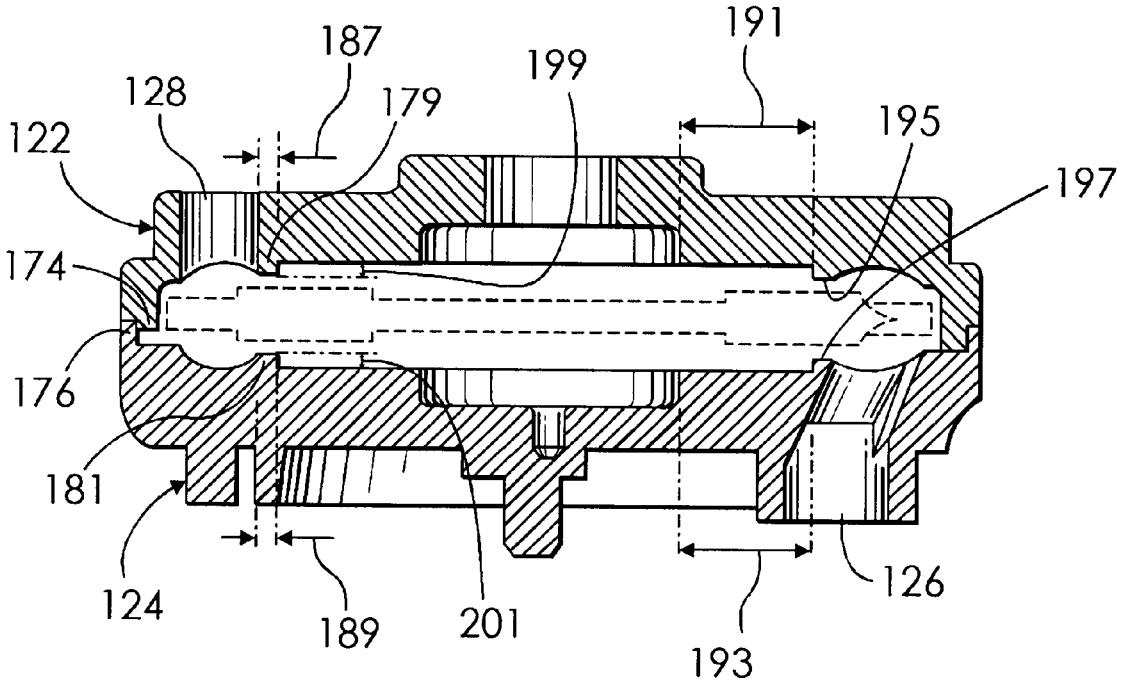
FIG. 9 is a cross sectional view of a fuel pump chamber member which is formed by the selective and operative engagement of the pump chamber body member which is shown in FIG. 7 and the pump chamber cover member which is shown in FIG. 8.

Referring now to FIGS. 7, 8, and 9, there is respectively shown a chamber body member 122, a chamber cover member 124, and a chamber assembly made in accordance with the teachings of a second embodiment of the present invention. Except as otherwise delineated below, body member 122 and cover member 124 are substantially identical in structure and function to body member 22 and cover member 24. Particularly, members 122 and 124 may selectively and operatively replace members 22 and 24 in the fuel pump assembly 10 which has been previously described. Moreover, with the exception of portions 178, 180, body member 122 and cover member 124 each respectively include substantially identical elements/portions/characteristics as body member 22 and cover member 24. Elements having a substantially identical structure and function are defined by the same reference numerals as body member 22 and cover member 24, delineated in FIGS. 3, 4 and 6, with the exception that elements of body member 122 and cover member 124 have their respective reference numerals incremented by 100.

Unlike portions 78, 80, portions 178, 180 of body member 122 and cover member 124 are not "tapered" or "sloped". Rather, portions 178, 180 each respectively have a generally circular and relatively narrow outer "landed" or raised portions 179, 181 which are contiguous to and integrally formed with generally circular inner recessed portions 183, 185. Portions 179, 181 are respectively contiguous to channels 173, 175 and have respective substantially identical and substantially flat opposed surfaces 195, 197.

Portions 179, 181 have respective widths 187, 189 which are relatively less than the respective widths 191, 193 of portions 183, 185. In one non-limiting embodiment, widths

187, 189 are each equal to approximately 2.0 millimeters and widths 191, 193 are each equal to approximately 6.0 millimeters. In one non-limiting embodiment, the amount or distance 199, 201 that portions 179, 181 respectively extend from recessed portions 183, 185 are substantially identical and, in one non-limiting embodiment, distances 199, 201 are each equal to approximately 0.05 millimeters.

Cover member 122 and body member 124 cooperate with impeller 16 to substantially ensure that minimal frictional contact results from the movement of impeller 16. Particularly, if impeller 16 is forced against body 122, the only contact which will occur is between portion 44 of impeller 16 and the relatively thin surface 195 of portion 179. Likewise, if impeller 16 is forced against cover 124, the only contact which will occur is between portion 44 of impeller 16 and the relatively thin surface 197 of portion 181. In this manner, frictional contact between the impeller 16 and body 122 and/or cover 124 is substantially reduced, thereby providing relatively greater impeller speeds, an increased pumping rate, and improved efficiency. Moreover, this "stepped" design allows body 122 and cover 124 to be more easily molded and requires less machining than the "tapered" or sloped design of body 22 and cover 24.

It is understood that the invention is not limited by the exact construction or method illustrated and described above but that various changes and/or modifications may be made without departing from the spirit and/or the scope of Applicants' inventions.

What is claimed is:

1. A fuel pump assembly comprising:

a motor having a selectively rotating shaft;

a chamber which receives said shaft ; and an impeller which is coupled to said shaft and which is movably disposed within said chamber, and which has a body portion having a thin inner portion and a thick outer portion and several blade portions which are integrally formed with and project from said thick outer body portion and which are each respectively thinner than said body portion.

2. The fuel pump assembly of claim 1 wherein said impeller further includes a ring portion which is connected to said several blade portions.

3. The fuel pump assembly of claim 2 wherein each of said several blade portions has a tip and wherein said ring portion is connected to each of said tips of said blade portions.

4. The fuel pump assembly of claim 1 wherein said body portion includes a plurality of apertures.

5. The fuel pump assembly of claim 1 wherein said inner portion of said body is deployed within a first portion of the chamber and wherein said outer portion of said body is deployed within a second portion of said chamber, said first and second portions of said chamber having a respective height and wherein said height of said first portion of said chamber is less than said height of said second portion of said chamber.

6. The fuel pump assembly of claim 1 further comprising a first member and a second member which cooperatively form said chamber.

7. The fuel pump assembly of claim 6 wherein said first and second members include grooves which cooperatively form a fuel path within said chamber.

8. A fuel pump assembly comprising:

a housing;

a motor disposed within said housing;

a shaft which is coupled to said motor and which is rotated by said motor;

a pump chamber body member having an aperture through which said shaft extends and further having a first surface in which a first channel is formed, said surface further including a first raised portion and a second portion;

a pump chamber cover member having a second surface in which a second channel is formed, and cooperating with said pump chamber body member to form a pump chamber; and an impeller which is coupled to said shaft, disposed within said pump chamber, and being rotated within said pump chamber by said motor, said impeller having a certain shape which cooperates with said first raised portion to substantially prevent contact between said impeller and said second portion as said impeller rotates within said chamber, said impeller further having a generally circular core portion and a plurality of blades projecting from said core portion, said core portion being thicker than each of said plurality of blades.

9. The fuel pump assembly of claim 8 wherein said cover member further includes a slotted portion, a second raised portion, and a third portion which is formed between said second channel and said slotted portion.

10. The fuel pump assembly of claim 8 wherein said cover member further comprises a thrust button which engages said shaft.

11. The fuel pump assembly of claim 8 wherein said first and said second channel cooperatively form a fuel passage channel through which said fuel is pumped.

12. The fuel pump assembly of claim 8 wherein said second portion is tapered.

13. The fuel pump assembly of claim 8 wherein said second portion is stepped.

14. A method for increasing the efficiency of a fuel pump of the type having a selectively rotating impeller including a generally circular body and several blades of a certain thickness which project from said body, said method comprising the steps of:

forming a thin inner portion on said circular body and a thick outer portion on said circular body; and reducing said thickness of said blades, effective to cause said thick outer portion of said body to be thicker than each of said blades.

15. The method of claim 14 further comprising the step of interconnecting said blades.

16. The method of claim 15 wherein each of said blades has a tip portion and wherein said step of interconnecting said blades comprises the step of interconnecting a member to said tip portion of each of said blades.

17. The method of claim 14 wherein said impeller is operatively placed into a chamber, said method for comprising the steps of tapering said chamber.

* * * * *